US006923285B1

(12) United States Patent
Rossow et al.

(10) Patent No.: US 6,923,285 B1
(45) Date of Patent: Aug. 2, 2005

(54) ATTACHMENT CONTROL DEVICE

(75) Inventors: Scott R. Rossow, Kindred, ND (US); Kenneth A. Brandt, Wyndmere, ND (US); Wally L. Kaczmarski, Lisbon, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 09/495,729

(22) Filed: Feb. 1, 2000

(51) Int. Cl.[7] ..... B60T 7/14; E02F 3/00; G06F 7/00

(52) U.S. Cl. ..... 180/272; 180/53.4; 414/699; 701/45; 701/50

(58) Field of Search ..... 180/272, 53.4; 414/699; 37/403, 404, 906; 307/10.3, 115; 701/45, 50

(56) References Cited

U.S. PATENT DOCUMENTS

| | | | | |
|---|---|---|---|---|
| 4,051,998 A | | 10/1977 | Zabel | 222/23 |
| 4,092,895 A | | 6/1978 | Zabel | 84/337 |
| 4,356,771 A | | 11/1982 | Theurer | 104/7 B |
| 4,459,591 A | | 7/1984 | Haubner et al. | 340/825.57 |
| 4,705,450 A | * | 11/1987 | Gano | 414/687 |
| 4,744,218 A | * | 5/1988 | Edwards et al. | 60/368 |
| 4,980,681 A | | 12/1990 | Noel | 340/825.69 |
| 5,265,686 A | | 11/1993 | Machen | 108/169 |
| 5,425,431 A | | 6/1995 | Brandt et al. | 180/273 |
| 5,486,724 A | | 1/1996 | Periou et al. | 307/10.1 |
| 5,546,683 A | | 8/1996 | Clark | 37/468 |
| 5,551,524 A | | 9/1996 | Yamamoto et al. | 180/6.62 |
| 5,577,876 A | | 11/1996 | Haeder et al. | 414/699 |
| 5,596,319 A | | 1/1997 | Spry | 340/903 |
| 5,680,099 A | | 10/1997 | Springston | 340/461 |
| 5,687,081 A | * | 11/1997 | Wellman et al. | 701/50 |
| 5,694,318 A | | 12/1997 | Miller et al. | 455/575 |
| 5,957,213 A | | 9/1999 | Loraas et al. | 172/2 |
| 6,030,169 A | | 2/2000 | Rossow et al. | 414/680 |
| 6,202,014 B1 | | 3/2001 | Brandt et al. | 172/12 |
| 6,260,357 B1 | | 7/2001 | Goodfellow et al. | 60/470 |
| D449,614 S | | 10/2001 | Osborn et al. | D14/412 |
| 6,308,441 B1 | * | 10/2001 | Bolitho | 37/411 |
| 6,504,266 B1 | * | 1/2003 | Ervin | 307/29 |

FOREIGN PATENT DOCUMENTS

| | | |
|---|---|---|
| EP | 0 741 209 A2 | 5/1996 |
| EP | 0 814 207 A2 | 12/1997 |
| EP | 0 860 557 A1 | 2/1998 |
| EP | 1 006 016 A2 | 11/1999 |

* cited by examiner

*Primary Examiner*—Paul N. Dickson
*Assistant Examiner*—Toan C To
(74) *Attorney, Agent, or Firm*—Joseph R. Kelly; Westman, Champlin & Kelly, P.A.

(57) ABSTRACT

The present invention provides an attachment for use with a power machine. An attachment control device includes a controller, such as a microprocessor, a microcontroller or other digital computer which senses the type of attachment and controls power to the attachment accordingly. In one embodiment, the attachment control device can be used for remotely controlling the attachment and includes an ignition switch and a stop switch and allows a user to operate the attachment from outside the operator compartment of the power machine, when the power machine is started from the attachment control device.

32 Claims, 7 Drawing Sheets

ATTACHMENT CONTROL DEVICE

INCORPORATION BY REFERENCE

The following patents are hereby fully incorporated by reference:

U.S. Pat. No. 5,425,431, issued Jun. 20, 1995, entitled "INTERLOCK CONTROL SYSTEM FOR POWER MACHINE," is incorporated herein by reference; and U.S. Pat. No. 5,577,876, issued Nov. 26, 1996, entitled "HYDRAULIC INTERLOCK SYSTEM," is incorporated herein by reference, both assigned to the same assignee as the present invention.

Reference is also made to co-pending U.S. patent application Ser. No. 09/130,986, entitled "REMOTE ATTACHMENT CONTROL DEVICE FOR POWER MACHINE," filed Aug. 7, 1998.

BACKGROUND OF THE INVENTION

The present invention deals with a power machine. More specifically, the present invention deals with a power machine having an attachment with a control device for controlling the attachment.

Power machines, such as skid steer loaders, typically have a frame which supports a cab or an operator compartment and a movable lift arm which, in turn, supports a work tool such as a bucket, an auger, a tree spade, or other work tool. The movable lift arm is pivotally coupled to the frame of the skid steer loader and is powered by power actuators which are commonly hydraulic cylinders. In addition, the tool is coupled to the lift arm and is powered by one or more additional power actuators which are also commonly hydraulic cylinders. An operator manipulating a skid steer loader raises and lowers the lift arm, and manipulates the tool, by actuating the hydraulic cylinders coupled to the lift arm, and the hydraulic cylinders coupled to the tool.

With a front attachment (or tool) such as a tree spade, cement mixer, etc., which utilizes one or more hydraulic actuators, a number of valves must typically be added to the hydraulic system of the skid steer loader in order to control the flow of hydraulic fluid under pressure to the plurality of cylinders on the attachment. In the past, the addition of these valves has required the addition of mounting hardware on the skid steer loader. For example, in some prior skid steer loaders, the valve bank used to control the hydraulic actuators on the attachment was mounted on the doorway of the cab or operator compartment. This required the hydraulic fluid under pressure to be routed to that valve bank, and then out to the attachment.

It is also common for control levers in skid steer loaders to have hand grips which support a plurality of buttons or actuable switches, actuable by the operator to perform certain functions. Depending on the particular type of attachment or attachments mounted on the skid steer loader, certain functions may be disabled or unusable. Further, depending on the particular type of attachment or attachments mounted on the skid steer loader, certain combinations of inputs from the operator input devices, when performed simultaneously, can result in opposing control valves being opened. This essentially provides an equal amount of pressurized fluid to both sides of a hydraulic actuator or hydraulic motor.

SUMMARY OF THE INVENTION

The present invention provides an attachment for use with a power machine. An attachment control device includes a controller, such as a microprocessor, a microcontroller or other digital computer which senses the type of attachment and controls power to the attachment accordingly. In one embodiment, the attachment control device can be used for remotely controlling the attachment and includes an ignition switch and a stop switch and allows a user to operate the attachment from outside the operator compartment of the power machine, when the power machine is started from the attachment control device.

DETAILED DESCRIPTION OF THE ILLUSTRATIVE EMBODIMENTS

Figure 1:
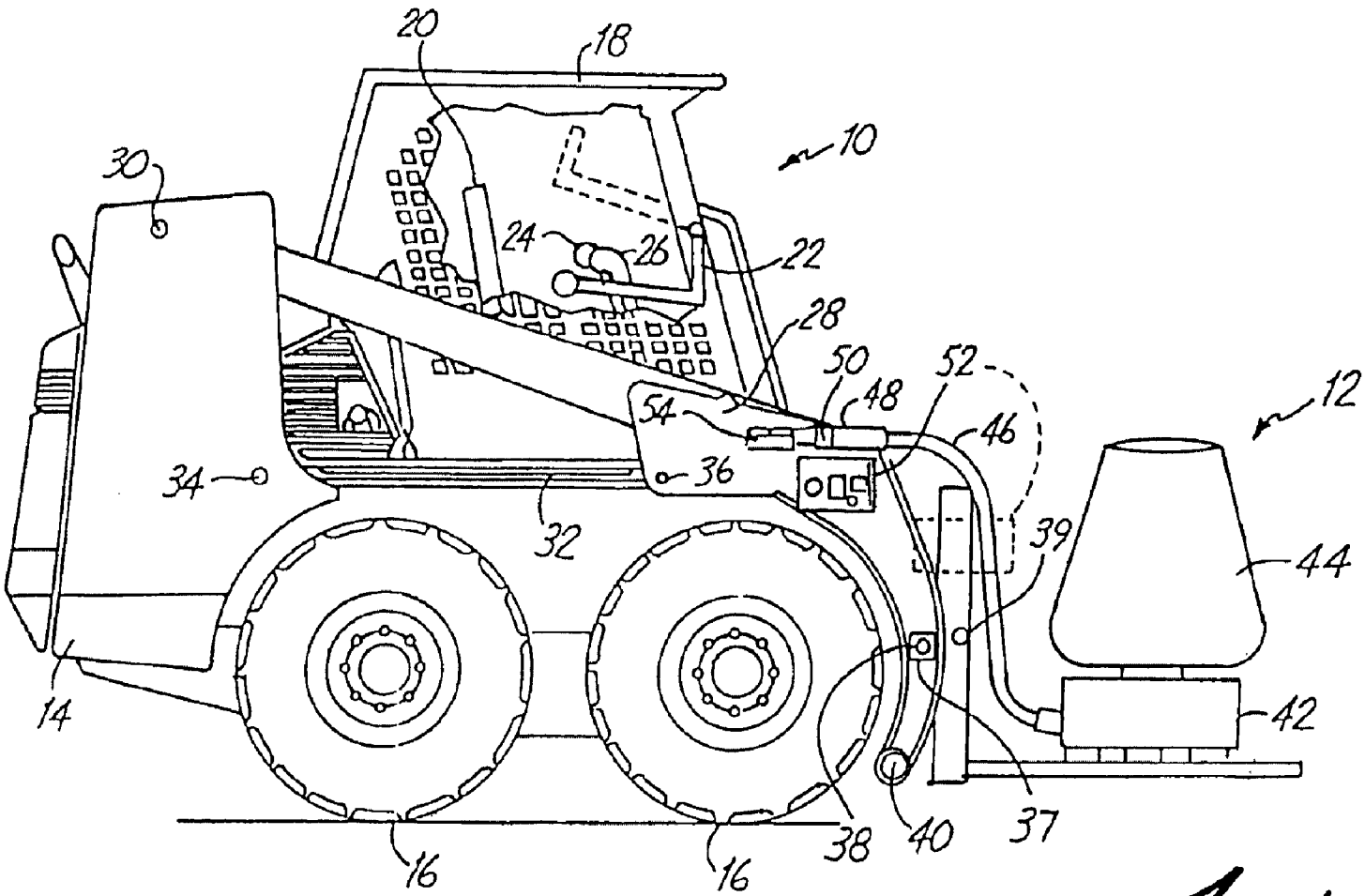
FIG. 1 is a side view of a skid steer loader with a cement mixer attachment.

FIG. 1 is a side elevational view of a skid steer loader 10 having an attachment 12 in accordance with one aspect of the present invention. Skid steer loader 10 includes a frame 14 supported by wheels 16. Frame 14 also supports a cab 18 which defines an operator compartment and which substantially encloses a seat 20 on which an operator sits to control skid steer loader 10. A seat bar 22 is pivotally coupled to a portion of cab 18. When the operator occupies seat 20, the operator then pivots seat bar 22 from the raised position (shown in phantom in FIG. 1) to a lowered position shown in FIG. 1. Cab 18 also typically includes a pair of control levers 24 and 26 with associated hand grips. Control levers 24 and 26 include actuable inputs (such as rocker switches, buttons or other operator input devices) for providing input signals.

A lift arm 28 is coupled to frame 14 at pivot points 30. A pair of hydraulic cylinders 32 (only one of which is shown in FIG. 1) are pivotally coupled to frame 14 at pivot points 34 and to lift arm 28 at pivot points 36. Lift arm 28 is coupled to attachment (such as a cement mixer) 12 by a tilt cylinder 37 which is coupled to lift arm 28 at point 38 and to attachment 12 at point 39. Attachment 12 is also illustratively attached to lift arm 28 at pivot point 40 or by any other suitable connection. Therefore, as tilt cylinder 37 is lengthened and shortened, cement mixer 12 can be tilted forward and back, respectively.

Cement mixer 12 includes hydraulic motor 42 and barrel 44. Motor 42 is coupled to barrel 44 by a direct drive connection, or a suitable chain drive or other mechanical drive linkage. Hydraulic motor 42 is coupled to the hydraulic power system of skid steer loader 10 through a set of hoses or conduits 46. Hoses 46 are coupled to attachment valve 48 by a suitable coupling such as a quick connect coupling. Valve 48 is, in turn, coupled to one or more hydraulic coupling devices 50 which receive fluid under pressure from the hydraulic power system of skid steer loader 10. Couplings 50 may be, for example, the front auxiliary hydraulic couplings provided on skid steer loader 10. Also, while valve 48 is illustrated in FIG. 1 as being mounted on loader 10, it can also be mounted on attachment 12. Illustratively, for some handheld attachments, valve 48 is mounted on machine 10 while for some other non-handheld attachments, valve 48 is mounted to the attachment 12.

In one illustrative embodiment, provision of hydraulic fluid under pressure to valve 48, and control of valve 48, can be accomplished in one of three ways. First, when attachment control device 52 does not have an associated remote operator input panel, device 52 simply controls valve 48 and hydraulic fluid provided to valve 48 based on a sensed input which is indicative of the type of attachment 12 to which it is attached. Second, control can be accomplished through actuator inputs on levers 24 and 26 from within cab 18. Further, control can be accomplished from outside cab 18 based on inputs received from a remote operator control panel associated with attachment control device 52.

Figure 3A:
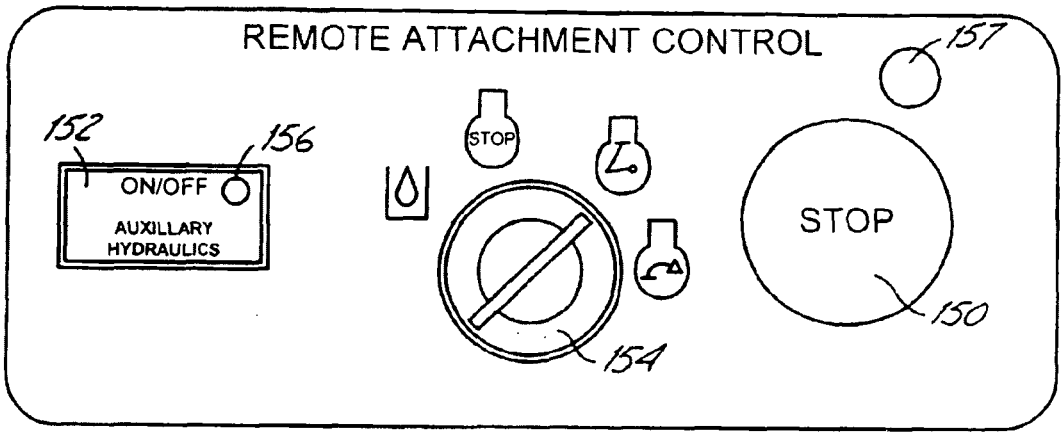
FIGS. 3A and 3B illustrate operator interface control panels in accordance with different aspects of the present invention.
Figure 3B:
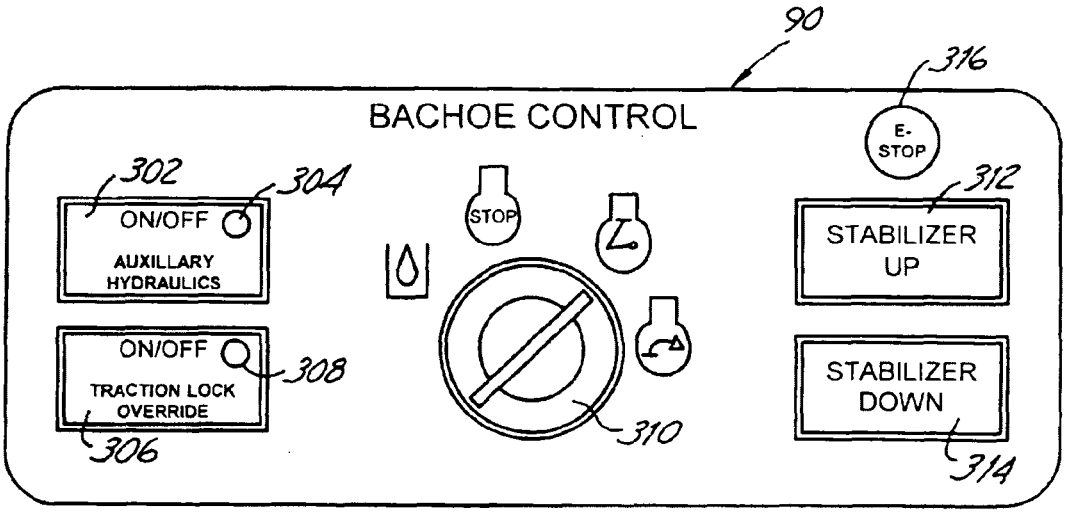

Device 52, in one illustrative embodiment, is mounted to the frame of loader 10 and includes a plurality of operator inputs on a display panel (or operator control panel) (shown in more detail in FIGS. 3A and 3B). Device 52, in another illustrative embodiment, is mounted directly to the attachment (as shown in phantom in FIG. 1). Device 52 provides an output to solenoid valve 48 for enabling the flow of hydraulic fluid through conduit 46 to hydraulic motor 42. Control device 52 is also coupled, through electrical connectors 54 and an electrical harness coupled thereto, to the electrical control system in skid steer loader 10.

In accordance with one embodiment of the present invention, control device 52 receives an identification signal indicating the type of attachment 12 it is connected to (e.g., whether the device is a high or low flow device or the precise identity of the device and its operating parameters). Device 52 then controls a main control computer on loader 10 to provide the correct amount of hydraulic flow to valve 48. Device 52 further controls valve 48 and any plumbing on attachment 12 to accomplish desired operation of attachment 12, based on operator inputs from the cab, the attachment, a remote control panel or another source.

In accordance with another embodiment of the present invention, control device 52 can be operated by an operator from the outside of cab 18. In such an embodiment, loader 10 is illustratively started through manipulating inputs to control device 52 found on a remote operator control panel. Attachment 12 and motor 42 can then be controlled through control device 52.

Alternatively, in accordance with another embodiment of the present invention, loader 10 and attachment 12 can be operated in a two-person mode. In that embodiment, one operator is seated in seat 20, with seat bar 22 in the lowered position. Loader 10 is then started from cab 18. Hydraulic fluid flow is provided from loader 10 to attachment 12 based on control inputs from the operator inside cab 18. However, control device 52 can be used to stop the flow of pressurized fluid to attachment 12. These modes of operation are discussed in greater detail later in the application.

Figure 2:
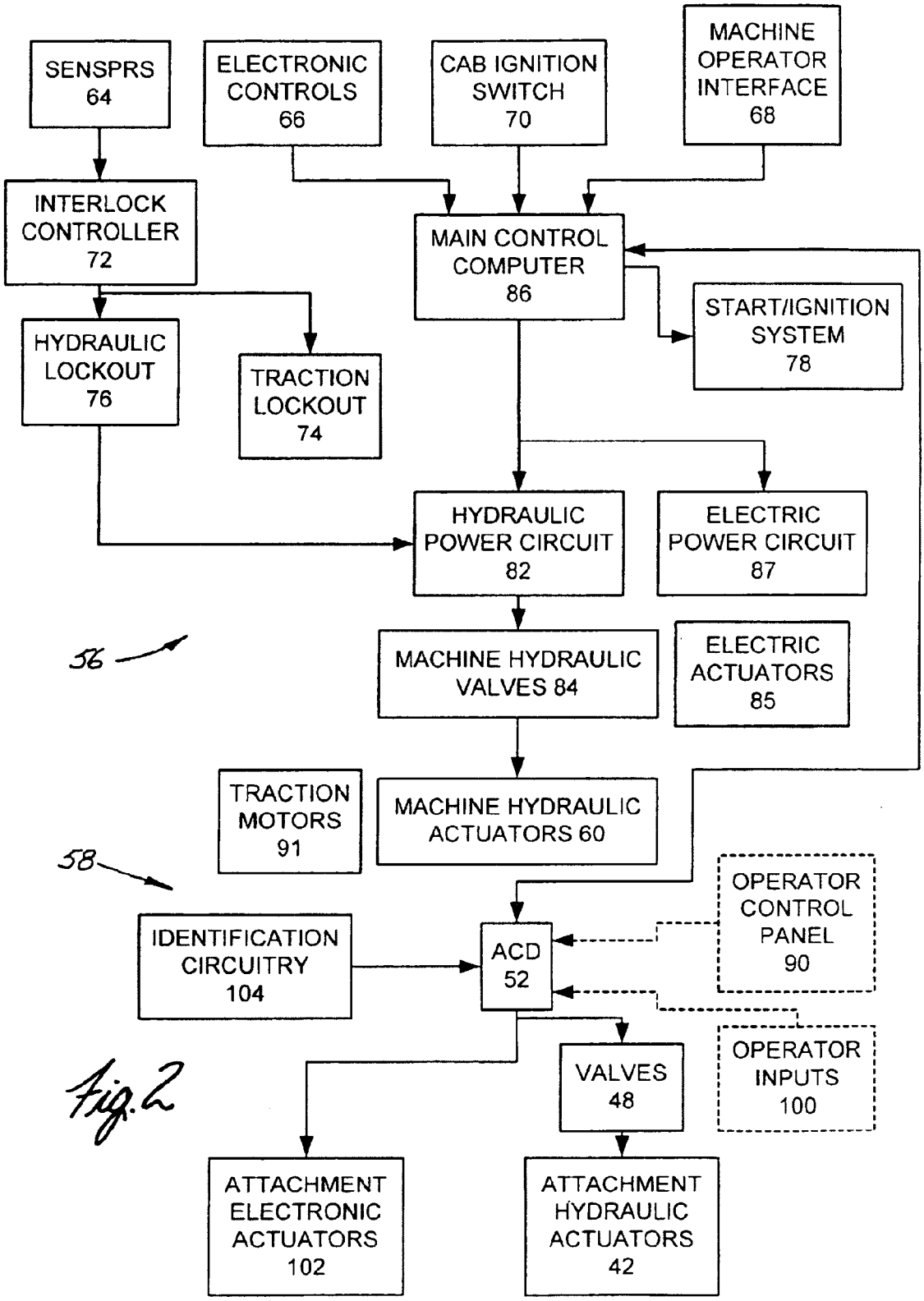
FIG. 2 is a block diagram of a control system controlling the cement mixer attachment shown in FIG. 1.

FIG. 2 is a block diagram of a control circuit for controlling loader 10 and attachment 12 in accordance with one embodiment of the present invention. The control circuit illustrated in FIG. 2 includes a machine control circuit 56 and attachment control circuit 58. FIG. 2 also illustrates machine actuators 60 (which in one illustrative embodiment include actuators 32) and attachment actuators 62 (which in one illustrative embodiment include hydraulic motor 42 and/or can include other hydraulic actuators and electric actuators 102). Machine control circuit 56 includes operating condition sensors 64, electronic controls 66, operator interface 68, cab ignition switch 70, machine interlock controller 72, machine traction lockout system 74, machine actuator lockout system 76, machine start/ignition system 78, hydraulic power circuit 82, machine actuator valves 84, electric power circuit 87, and electric machine actuator 85. Attachment control circuit 58 includes attachment control device 52 (also shown in FIG. 1), optional operator control panel 90 and attachment solenoid valve 48 (also shown in FIG. 1). FIG. 2 also shows that attachment 12 can include identification circuitry 104 and operator inputs 100 (such as triggers or buttons on a handheld attachment).

It should also be noted that FIG. 2 shows valve 48 attached to attachment 12. However, valve 48 can be attached to machine 10 as well. Similarly, attachment 12 may be provided with additional valves which are controlled by attachment control device 52.

Operating condition sensors 64 illustratively include sensors for sensing desired operator conditions of loader 10. Such sensors can include sensors which provide signals indicative of the position of seat bar 22, and sensors which provide signals indicative of the presence of an operator in seat 20. Such sensors are described in greater detail in U.S. Pat. Nos. 5,425,431 and 5,577,876, both of which are incorporated above by reference. Briefly, such sensors illustratively include Hall effect, infrared, or other suitable sensors which provide an output signal to machine interlock controller 72 which is indicative of the sensed parameter. Based on those signals, machine interlock controller 72 controls functionality of skid steer loader 10 and the attachment 12 associated therewith.

Machine interlock controller 72 illustratively includes a digital computer or other suitable microcontroller. Machine interlock controller 72 receives inputs from the various input mechanisms and controls the functionality of skid steer loader 10.

Electronic controls 66 provide signals indicative of operator inputs from within cab 18. Such electronic controls can include, for example, hand grips on levers 24 and 26, switches or buttons or other operator input devices associated with the hand grips 24 and 26, operator inputs from foot pedals within cab 18, inputs from membrane or keypad or touch screen inputs provided in cab 18, or any other suitable operator input devices.

Operator interface 68 illustratively provides a visual or audible indication to the operator which indicates the desired operator conditions or operating characteristics sensed in the machine or the associated attachment 12. Operator interface 68 may, for example, include a LCD display, a CRT-type display terminal, a series of LEDs, audible indicators, or other suitable operator interface devices.

Cab ignition switch 70, in one illustrative embodiment, is a simple key switch, which, when turned or closed, provides power (either directly or through computer 86 or device 52) to machine start/ignition system 78. In response, machine start/ignition system 78 cranks the engine in skid steer loader 10 to start the engine.

Hydraulic power circuit 82, in one illustrative embodiment, includes a source of hydraulic fluid under pressure. Such a source can, for example, include a pump driven based on power generated by the engine of skid steer loader 10. Hydraulic power circuit 82 also illustratively includes a main hydraulic valve which can be actuated to provide hydraulic fluid under pressure to the various actuators and couplings, and other valves, on skid steer loader 10.

Electric power circuit 87, in one illustrative embodiment, includes an electrical power system for machine 10. Such a system can be implemented in any suitable way, including those set out in the patents and patent applications incorporated herein by reference. In one illustrative embodiment, electric power circuit 87 can be controlled (based on operator inputs through electronic controls 66) to control the hydraulic power circuit 82 in a pulse width modulated, or continuous fashion. In such an embodiment, electric power circuit 87 provides an output to control machine valves 84, which are controlled to selectively provide hydraulic fluid under pressure to machine actuators 60.

When in a continuous or pulse width modulation operation mode, power control circuit 87 receives inputs from electronic controls 66 (through main computer 86) and provides a continuously variable signal to machine actuator valves 84 to control flow through valves 84 in a continuously variable fashion. In an on/off operation mode, power control circuit 87 receives operator inputs from electronic controls 66 (through main computer 86) and controls valves 84 in an on/off fashion, either allowing full flow through the valves, or completely blocking flow through the valves.

In either case, hydraulic fluid under pressure is provided from valves 84 to actuators 60.

Machine actuator valves 84 also include valves for providing hydraulic fluid under pressure to traction motors 91 used for driving wheels 16, and any other power actuators associated with machine 10.

Machine interlock controller 72, in conjunction with machine traction lockout system 74 and machine actuator lockout system 76 are used in modifying the functionality of machine 10. In one illustrative embodiment, machine actuator lockout system 76 is used to lockout or modify the operation of certain of the machine power actuators 60 associated with machine 10. Similarly, machine traction lockout system 74 illustratively locks out or modifies the operation of the traction motors 91 used to drive wheels 16 (or other traction devices such as tracks used on a mini-excavator). The lockout systems are used under certain conditions which may be sensed by operating condition sensors 64, which may be input by the operator through electronic controls 66, or which may be communicated to machine interlock controller 72 through main computer 86.

In one illustrative embodiment, machine actuator lockout system 76 includes a valve, or an electronic circuit or other suitable mechanism, for locking out the operation of one or more machine actuators 60. Machine traction lockout system 74 includes a valve or valve arrangement, an electronic circuit, or another suitable mechanism, for locking out or modifying the operation of the traction motors 91 used in driving wheels 16.

Systems 74 and 76 are controlled based on outputs from controller 72. For instance, when controller 72 is not powered up, lockout mechanisms 74 and 76 are disposed in a lockout configuration precluding operation of the associated actuators and traction mechanisms. However, once controller 72 is powered up, and during normal operation when controller 72 has received an indication that an operator is in seat 20 with seat bar 22 in the lowered position, controller 72 unlocks lockout systems 74 and 76, allowing functionality of the hydraulic system on loader 10. However, if the operator raises seat bar 22 or gets out of seat 20, operating condition sensors 64 provide suitable signals to machine interlock controller 72 causing controller 72 to implement lockout conditions by manipulating lockout systems 74 and 76 to lock out operation of selected hydraulic functions. Controller 72 then provides an operator observable indication at operator interface 68 indicating the lockout conditions which have been implemented.

Attachment control device 52, in one embodiment, includes an operator control panel or interface 90 (which is discussed in greater detail in FIGS. 3A and 3B) by which an operator can provide inputs to control device 52 which, in turn, provides inputs to main computer 86. Based on the inputs provided by the operator through interface 90, under certain circumstances described in greater detail below, the operator can initiate operation of certain functions in loader 10 from interface 90 and control device 52, thereby allowing the operator to implement certain control of attachment 12.

As is described in greater detail below, if the operator starts loader 10 from panel 90 and control device 52, main computer 86 renders substantially all functions previously performable from within cab 18, inoperable. While an operator can still shut down loader 10 and attachment 12 from within cab 18, all other functions are inoperable.

In addition, when the operator starts loader 10 from panel 90 and control device 52, the operator can also control the provision of hydraulic fluid under pressure, through the base valve in hydraulic power circuit 82, and through attachment solenoid valve 48, to attachment actuators 62. In that instance, device 52 senses the type of attachment 12 which is present based on the inputs from circuitry 104 and provides outputs to computer 86 requesting flow on a certain output from machine 10 which is connected to valve 48. Device 52 also controls valve 48 to provide desired flow therethough. Main computer 86 implements the necessary logic to deliver hydraulic fluid under pressure to attachment solenoid valve 48, and attachment actuator 62, as requested by the operator through interface 90 and control device 52.

Further, as will be described in greater detail below, and in one illustrative embodiment, if the operator starts loader 10 from device 52, machine interlock controller 72 is never powered up. Thus, the machine lockout system 74 and 76 remain in the lockout position thereby locking out the predesignated actuators and traction mechanisms on skid steer loader 10. In other words, in one illustrative embodiment, when operation of skid steer loader 10 and attachment 12 is initiated through control device 52 and interface 90, the only thing which the operator can control is the provision of hydraulic fluid through valve 48 to attachment actuators 60, and the starting and stopping of the engine in loader 10. Substantially all other functions of loader 10 are locked out. In another embodiment, also described below, the traction lockout can be overridden by the operator from panel 90.

FIG. 2 also illustrates that, in one illustrative embodiment, attachment 12 can include operator inputs (such as where attachment 12 is a hand held attachment such as an air hammer or jackhammer, rather than a cement mixer). Operator inputs 100 can include, for example, trigger inputs, lever inputs, or buttons or other actuators. Similarly, attachment 12 can optionally include attachment electric actuators 102. Actuators 102, for example, can include electric motors or other types of electric actuators. In one illustrative embodiment, identification circuitry 104 is simply a group of pins connected to predetermined voltage potential (such as ground or plus 5 volts, for example) and wired to attachment controlled device 52 through an appropriate wiring harness used to plug attachment control device 52 into attachment 12, computer 86 and electronic power circuit 87. The pin configuration identifies the particular attachment or attachment type. Device 52 can then obtain operation parameters from a look-up table or other suitable way, so it can control attachment 12 appropriately.

Machine 10 and attachment 12 can be controlled in a number of different modes. The first mode does not require a control panel 90, while the remaining modes do. Those modes, along with panels 90 (where appropriate) will now be described.

In the first mode of operation, attachment control device 52 includes a programmable controller and no remote operator interface or control panel 90. In that embodiment, attachment control device (ACD) 52 simply senses the type of attachment 12 to which it is connected, based on the output from identification circuitry 104. For instance, different types of attachments can require lower or higher hydraulic flow for operation. Therefore, upon sensing the attachment type, ACD 52 provides an output to main computer 86 such that main computer 86 controls hydraulic power circuit 82 to provide only the desired volume of hydraulic fluid flow at the output coupled to valve 48 on attachment 12. Attachment control device 52 also provides an output to valve 48 to control attachment 12. In the event that there are more than one attachment hydraulic actuator 62, valve 48 is actually composed of a bank of valves which are controllably opened and closed to obtain desired operation of attachment 12. Based upon the identification of attachment 12 from circuitry 104, and based upon inputs from user interface 100 (on a handheld machine, for instance) or from electronic controls 66, ACD 52 provides an output to valves 48 to configure valves 48 such that, when hydraulic flow is received from the hydraulic coupler to hydraulic power circuit 82, that hydraulic flow is routed properly through valves 48 to the desired attachment hydraulic actuators 42. It can thus be seen that, in this mode of operation, ACD 52 handles some of the processing overhead associated with the attachment 12. This reduces the processing load of computer 86, while still reducing the amount of valving hardware and plumbing required for machine 10 to accommodate a wide variety of attachments.

The next mode of operation requires a control panel 90. FIG. 3A is an illustration of operator interface 90, discussed in FIG. 2. Interface 90 includes engine stop switch 150, attachment on/off switch 152, key switch 154, and visual indicator light 156. In one illustrative embodiment, engine start switch 154 operates substantially the same as a conventional key switch. Switch 154 is rotated to the extreme clockwise position in order to start the engine in loader 10 from control panel 90. Once the engine is running, engine start switch 154 remains in the run position illustrated in FIG. 3A.

Also, switch 154 can be rotated to the far counterclockwise position to release any pressure remaining at valve 48 when operation is completed. Alternatively, the far-left position of switch 154 can be replaced by a depressible button, or rocker switch or other type of button or switch which can be pushed and held, or otherwise actuated, to release hydraulic pressure.

Stop button 150, in one illustrative embodiment, is a detente button which can be actuated simply by depressing the button, and can be de-actuated only by twisting the button clockwise. Thus, when the operator wishes to stop all operations of loader 10 and attachment 12, the operator simply depresses button 150. The loader 10 and attachment 12 cannot be restarted until the operator twists button 100 clockwise and allows the button to resume its undepressed position.

Attachment on/off switch 152, in one illustrative embodiment, is a momentary rocker switch, or push button or other suitable switch which can be actuated and de-actuated. When actuated, switch 152 requests hydraulic fluid under pressure to be delivered to the attachment. When de-actuated, switch 152 requests hydraulic fluid under pressure to be blocked from delivery to the attachment. When hydraulic fluid is being delivered to the attachment, switch 152 illustratively includes a visual indicator on the upper portion thereof (such as LED 156) which is lighted. The LED is illustratively turned off when switch 152 is turned off.

Another visual indicator light 157, in one illustrative embodiment, is used to indicate to the operator that interface 90 is non-functional (except for stop switch 150). Therefore, and as is discussed in greater detail below, if the operator starts the engine of loader 10 from within cab 18, or if the operator depresses switch 150 and has not yet rotated switch 150 to allow it to resume its undepressed position, indicator light 157 is lighted. This indicates that neither switch 152 nor engine start switch 154 are operable from interface 90. In all other cases where switches 152 and 154 are operable, LED 157 is not lighted.

Figure 4A:
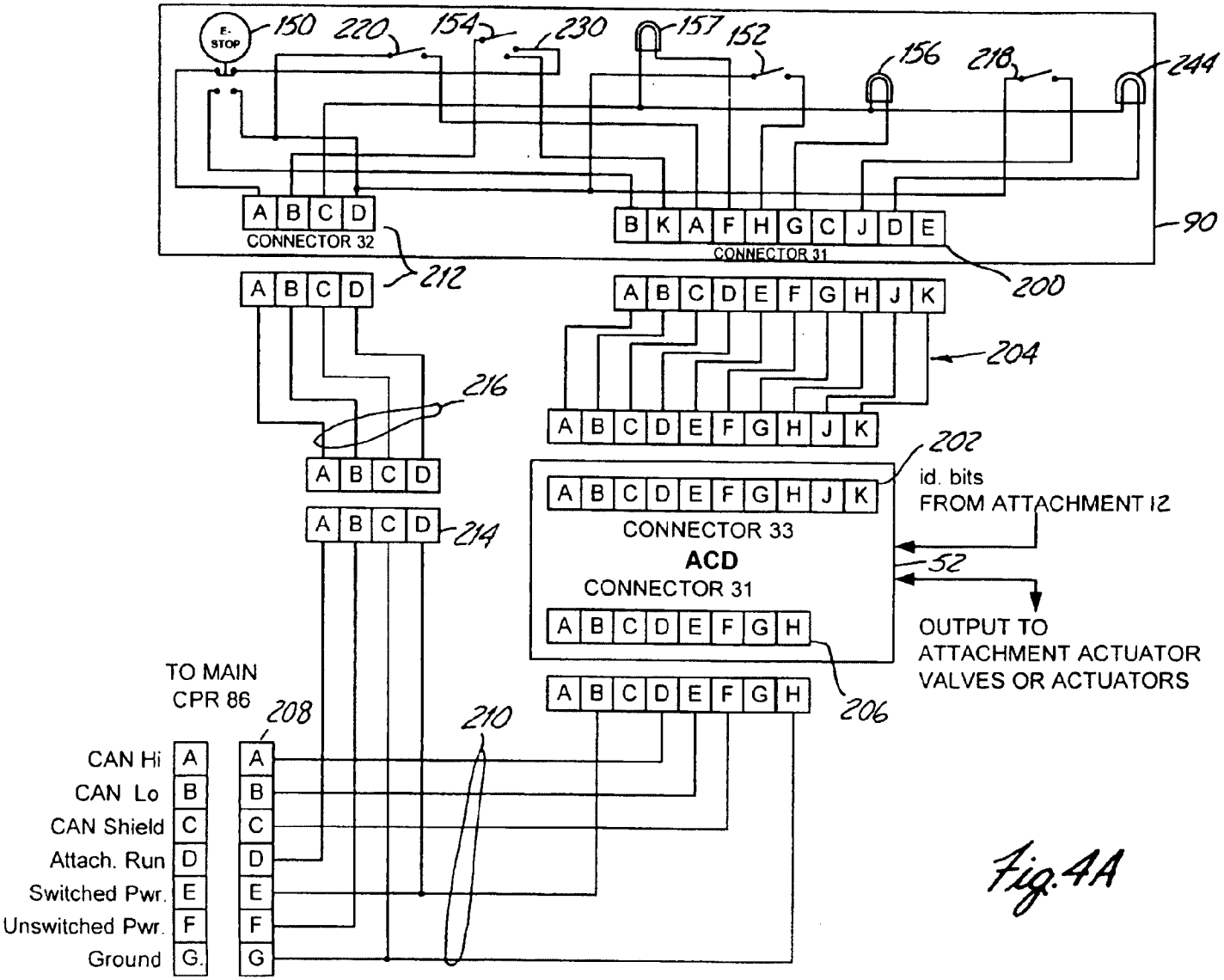
FIGS. 4A and 4B are more detailed diagrams of the logic circuits associated with the control panels shown in FIGS. 3A and 3B.

FIG. 4A is a more detailed schematic diagram of the embodiment of operator interface panel 90 shown in FIG. 3A. FIG. 4A shows an embodiment in which ACD 52 is comprised of a programmable controller or microprocessor or similar digital logic device. ACD 52 is coupled to control panel 90 through a pair of connectors 200 and 202, which are coupled together by a suitable cable or harness 204. FIG. 4A also shows that ACD 52 is coupled to main control computer 86 through a pair of connectors 206 and 208, which are also coupled to one another by a suitable cable or harness 210. FIG. 4A further illustrates that control panel 90 is directly connected to main control computer 86 through a pair of connectors 212 and 214 which are also connected to one another by a suitable harness or cable assembly 216. Further, FIG. 4A illustrates control panel 90 with an additional operator input button or switch 218 which provides a high flow input to ACD 52. FIG. 4A further illustrates that auxiliary pressure relief is accomplished through a separate button 220 (as described above), rather than through moving key switch 154 to its far counter clockwise position.

If the user wishes to operate attachment 12 from inside the operator's compartment on the machine 10, the user simply turns the cab ignition switch 70 and thereby starts the motor of loader 10. In that case, main control computer 86 provides a serial communication signal over the controller area network (CAN) (specifically lines CAN HI and CAN LO over cable harness 210) to ACD 52. In that instance, ACD 52 does not enable the auxiliary enable input, the high flow input and the auxiliary pressure relief input 220 from panel 90. Instead, those inputs are simply ignored. However, if the user or another person attempts to start the ignition by turning key switch 154 or panel 90 to the start or ignition position, ACD 52 detects that signal and provides an indication of that over the CAN HI and CAN LO lines to main computer 86. In response, main computer 86 shuts down ignition system 78 and the motor in machine 10. Similarly, if anyone wishes to halt operation of loader 10, engine stop button 150 on panel 90 can simply be depressed. This provides an input to ACD 52 which is communicated to main computer 86 by a serial communication over the CAN link indicating that the engine stop button 150 was depressed. In response, computer 86 shuts down operation of attachment 12.

By contrast, if the user wishes to operate attachment 12 from a remote location, outside the operating compartment of loader 10, the user first drives loader 10 to a desired position from within the cab or operators compartment and positions the lift and tilt cylinders such that attachment 12 is in a desired position. The user then shuts off machine 10 and exits the operating compartment.

The user then turns key switch 154 on control panel 90 to the start position (which is the furthest clockwise position shown in FIG. 4A). This provides a logic HI signal to ACD 52. ACD 52, in turn, provides a serial ignition signal over the CAN communication link to control computer 86 indicating that ignition has been requested. Computer 86, in response, provides an output signal to start/ignition system 78 to start the motor of loader 10. It should be noted that, once the motor has been started and the user releases key switch 154, it moves to the second position 230, which is the run position. In that instance, a logic HI level is coupled through engine stop button 150, back through connector 208 to main control computer 86, as a signal labeled the Attachment Run signal in FIG. 4A. The Attachment Run signal is provided as a direct hard wired link to computer 86 so that the user can immediately interrupt operation of attachment 12 by depressing engine stop button 150. This open circuits the attachment run signal causing main control computer 86 to completely shut down the system.

Assuming the user has not depressed engine stop button 150, and the engine of loader 10 is running, the user can then begin operation of attachment 12 by depressing the auxiliary enable switch 152. This sends a signal through connectors 200 and 202 to ACD 52 which, in turn, provides a corresponding serial communication over the CAN link to main computer 86. In response, main computer 86 determines that a request has been made for hydraulic flow and provides an output to machine hydraulic power circuit 82 and valves 84 to provide hydraulic fluid under pressure through the output connection to valve 48. ACD 52 also provides a suitable output to valve 48 to control the position of valve 48 (and any other valves associated with attachment 12) such that attachment 12 operates as requested by the user. Of course, as discussed above, the output to attachment 12 can be based, at least in part, on the identification of attachment 12 from identification circuitry 104.

In the event that the user wishes to invoke high flow option (which provides increased hydraulic flow to attachment 12), the user simply closes switch 218. This provides a corresponding signal to ACD 52 which communicates that signal to main control computer 86 over the CAN communication link. Main control computer 86, in turn, controls hydraulic power circuit 82 and valves 84 to provide the increased hydraulic flow requested.

It should also be noted that, in an illustrative embodiment discussed above with respect to FIG. 3A, control panel 90 includes LEDs 156 and 157 and can also include LED 244. In one illustrative embodiment, ACD 52 receives a signal from computer 86 indicating that the user has started the engine from the cab. ACD 52 then illuminates LED 157 to indicate this. Similarly, ACD 52 illuminates LEDs 156 and 244 when the user has closed the Auxiliary Enable switch 152 or the HI FLOW switch 218, receptively.

As with the above-identified co-pending application, the present system can also be used in a two-person operation mode. In that mode, a first operator starts the engine of loader 10 from within the operator compartment on loader 10, and actuates an operator input such that main control computer 86 provides hydraulic fluid under pressure to attachment 12. A second person can then stop operation of attachment 12 by depressing engine stop button 150 on the remote panel 90. Thus, the driver can reposition machine 10 and attachment 12 from within the cab while allowing the remote user the ability to use and stop operation of attachment 12.

FIG. 3B illustrates another illustrative embodiment of control panel 90. In FIG. 3B, control panel 90 is implemented as a control panel for controlling the operation of a backhoe attachment which attaches to loader 10.

Figure 5:
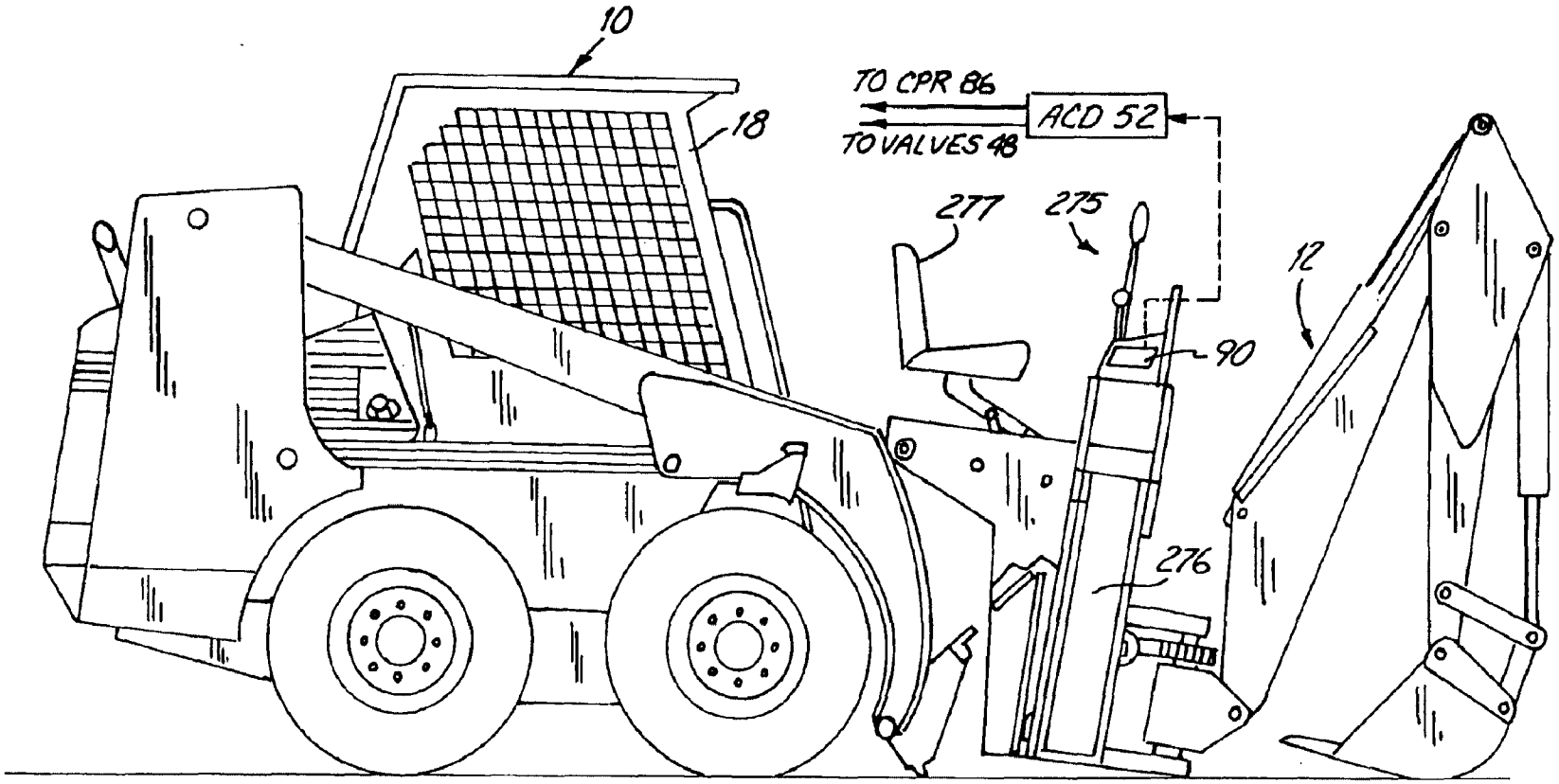
FIG. 5 is an illustration of one embodiment of a backhoe attachment.

FIG. 5 is an illustration of a backhoe attachment 12 coupled to machine 10. Backhoe attachment 12 includes its own user actuable inputs 275 for actuating the hydraulic functions of the backhoe 12. FIG. 5 also illustrates control panel 90 and ACD 52 (which can be mounted on either machine 10 or backhoe 12). FIG. 5 further illustrates stabilizer 276, another of which is identically disposed on the opposite side of backhoe 12 from that shown in FIG. 5.

In a normal embodiment, the backhoe attachment provides certain backhoe controls 275 which are located on the backhoe. The operator exits the operators compartment of machine 10 and enters a separate backhoe seat 277 which is located on the attachment. However, it is quite common that, when operating a backhoe, the user may wish to adjust the stabilizers 276 which operate to stabilize loader 10 during backhoe operation. Similarly, the user may wish to move the loader forward or reverse and then continue operation of the backhoe.

In the past, the ignition and run switch was located only in the cab of machine 10, as were the stabilizer control actuators. Similarly, when the user left the operator compartment to operate the backhoe, interlock controller 72 would lock out operation of the traction motors. Therefore, the only way the operator could move the loader forward or reverse was to reenter the operator compartment and actuate the appropriate traction lock override button and operator inputs to move the loader in a forward or reverse direction, as desired.

FIG. 3B illustrates that control panel 90 disposed on backhoe 12 includes attachment on/off button 302 with an associated LED 304, traction lock override on/off button 306 with an associated LED 308, key switch 310, and stabilizer up and stabilizer down buttons 312 and 314, respectively. Panel 90 also includes an engine stop button 316.

Figure 4B:
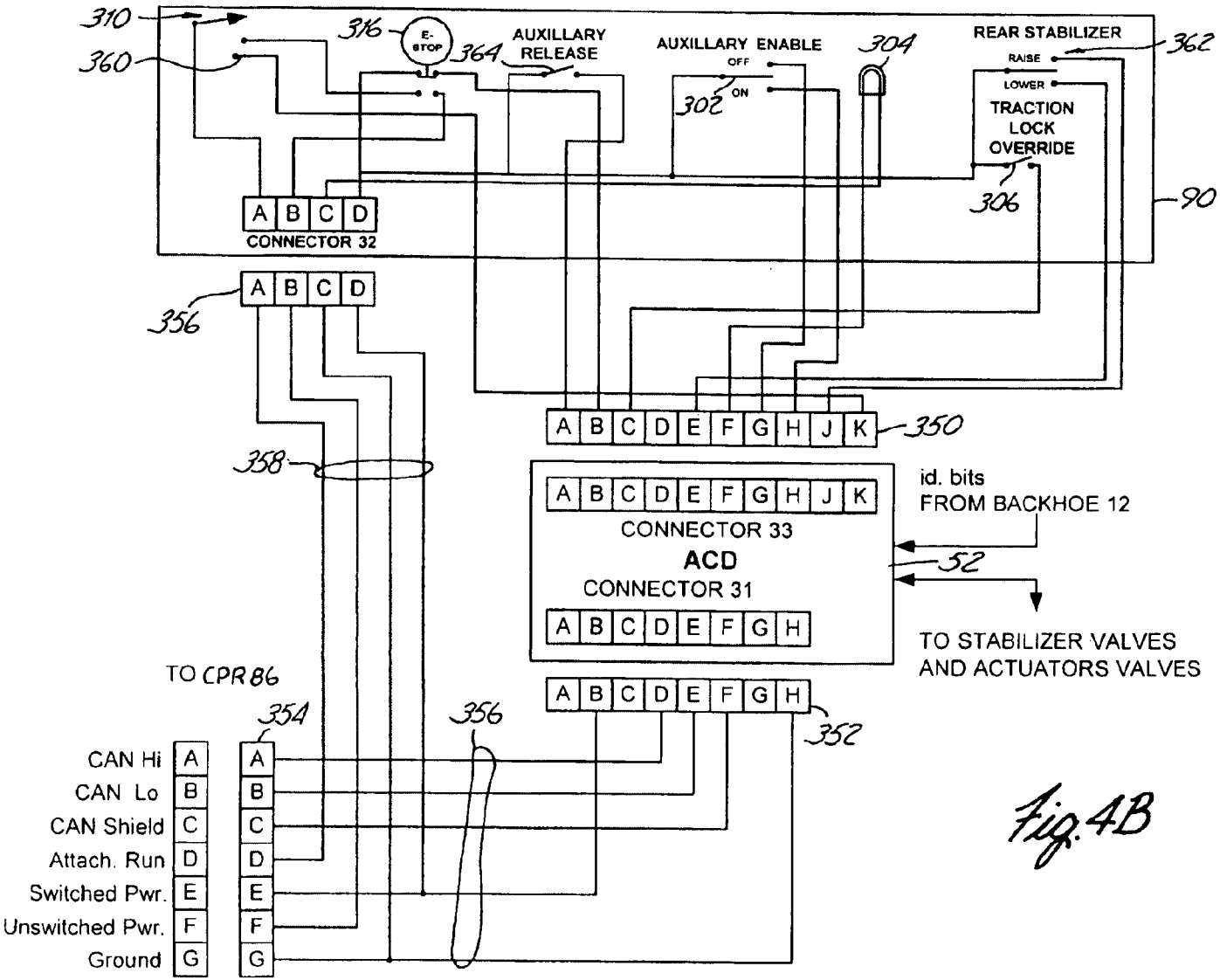

FIG. 4B is a schematic diagram illustrating control panel 90 (similar to that of FIG. 3B) coupled to an ACD 52. Rather than having two stabilizer buttons 312 and 314, the embodiment shown in FIG. 4B has a single, two position switch 362. Similarly, rather than providing pressure relief through key switch 310, the embodiment in FIG. 4B provides a separate switch 364. However, operation is similar. FIG. 4B also shows that control panel 90 is coupled, through connector 350, to the various components on control panel 90, and through connectors 352 and 354, through a suitable wire harness 356, to computer 86 on machine 10. Similarly, FIG. 4B shows that control panel 90 is directly connected to machine 10 through connectors 354 and 356 and an appropriate cable or wire harness 358.

The operation of ACD 52 and the embodiments of control panel 90 shown in FIGS. 3B and 4B will now be described with respect to both of those figures. As described above with respect to FIGS. 3A and 4A, ACD 52 is implemented as a digital microcontroller, a microprocessor or other type of digital computer.

In one illustrative embodiment, operation of the backhoe attachment is initiated by first entering the cab of machine 10 and placing it in a run state. By that it is meant that, where the machine has, as its normal ignition switch, a simple key switch, the key switch is placed in the run (as opposed to the ignition or start) position. However, if machine 10 is equipped with a deluxe user interface panel which includes menu driven inputs for starting the machine (which often requires the input of a user password), the user must input an appropriate password and take whatever other actions are required by the menu driven user interface to place the machine in the run state. Then, the user can operate the backhoe attachment from panel 90 shown in FIGS. 3B and 4B.

For example, in order to start the engine in loader 10, the user rotates key switch 310 to the run position 360. This causes a logic high voltage to be applied to an input to ACD 52 through connector 350. ACD 52 provides a serial communication to computer 86 over the CAN link indicating that the engine start (or ignition) signal has been received. In response, computer 86 provides a start signal to start/ignition system 78 to start the engine of loader 10. Of course, the user can always stop the attachment and engine in loader 10 by depressing engine stop button 316. This provides a signal over connector 352 to computer 86 which immediately stops the engine in loader 10.

Once the engine is started, in order to provide hydraulic pressure to backhoe 12, the user simply depresses the attachment on/off switch 302 (or moves it to the on position). This provides a signal through connector 350 to ACD 52. ACD 52, in turn, provides a serial communication to computer 86 over the CAN communication link indicating that hydraulic fluid under pressure has been requested. In turn, computer 86 provides an output to hydraulic circuit 82 and valves 84 causing them to provide hydraulic fluid through the appropriate coupling (such as an auxiliary coupler) to backhoe 12. ACD 52 also provides outputs to any necessary valves on backhoe 12 to ensure hydraulic flow reaches the desired user-actuated valves or actuators.

Similarly, in order to actuate the rear stabilizers, the user can depress either the stabilizer up button 312 or the stabilizer down button 314. It should also be noted, as illustrated in FIG. 4B, the stabilizer up and down functions can be implemented with a single, dual position, switch 362. In any case, a movement of the stabilizer actuation switch to a desired position causes a corresponding signal to be input to ACD 52 over connector 350. ACD 52 thus provides a serial communication over the CAN link to computer 86 indicative of the stabilizer input signal received from control panel 90. In response, computer 86 provides a signal to hydraulic power circuit 82 to provide hydraulic fluid under pressure to a suitable coupler to the backhoe. It should also be noted that, in one illustrative embodiment, ACD 52 can provide a signal to stabilizer valves on backhoe 12 which are connected to the hydraulic actuators which move the stabilizers in order to raise or lower the stabilizers as requested by the user.

As discussed with the auxiliary release button in FIGS. 3A and 4A, the user can actuate the auxiliary release button (either by turning the key switch all the way to the left, or by depressing a separate button or actuator). ACD 52 provides a serial communication over the CAN link to computer 86 indicating that the auxiliary release signal has been received from the user. Computer 86 provides a suitable output to hydraulic power circuit 82 and valves 84 to release hydraulic pressure currently in the hydraulic line provided to the backhoe 12.

It should also be noted that, since the user is not in the operator's seat in the operator's compartment with the seat bar in the lowered position, the interlock controller 72 has maintained the traction motors in the locked configurations such that the loader cannot be moved. However, as also described in the above-identified and incorporated issued U.S. patents, a traction lock override can be provided such that the user can depress a traction lock override button or other actuator and override the traction lock invoked by the interlock controller 72. This is illustrative a momentary switch such that the traction motors will be allowed to move either forward or reverse for a short period of time after the traction lock override button is depressed. This can also be a detent-type actuator button such that, once depressed, the traction lock can be overridden by the operator until the button is depressed again.

The embodiment of the present invention currently being discussed provides traction lock override actuator 306 on control panel 90 as well. Therefore, the user can override the traction lock instated by interlock controller 72 by simply depressing or closing switch 306. This provides a signal to ACD 52 through connector 350. In response, ACD 52 provides a serial communication over the CAN link to main computer 86. Computer 86 then provides an output to the hydraulic circuit 82 which causes hydraulic power to be output. This enables the user to then move loader 10 (and attachment 12) by manipulating the control levers in a desired direction while the traction lock override switch is closed.

While control panel 90 in FIG. 4B shows but one LED 304, any desired number of LEDs or other visual indicators can be provided. In the illustrative embodiment, ACD 52 provides an output to illuminate the LEDs to thereby provide the operator with an indication of the particular operating mode which the machine is then in. For example, when the attachment on/off button is depressed, LED 304 is illuminated by ACD 52 to indicate that the attachment has been enabled. Similarly, when the traction lock override switch 306 is closed, ACD 52 illustratively provides a signal to LED 308 (not shown in FIG. 4B, but illustrated in FIG. 3B) to illuminate that LED thus indicating that the traction lock override switch has been closed.

Figure 6:
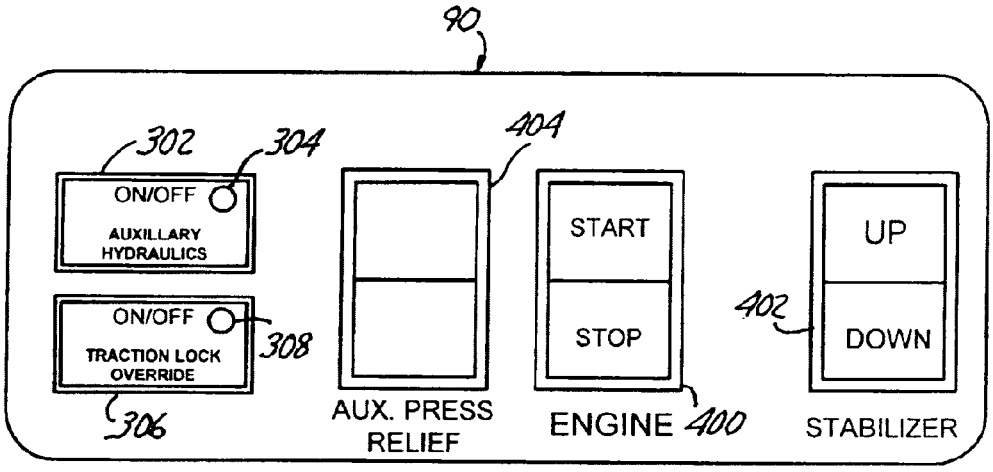
FIG. 6 is an operator interface control panel in accordance with another embodiment of the present invention.

FIG. 6 shows another embodiment of control panel 90. Similar items are numbered the same as those in previous FIGs. However, rather than having separate key switch 310 and engine stop button 316, the embodiment illustrated in FIG. 6 shows a rocker switch 400 which serves as the ignition switch when moved to the START position and as the engine stop switch when moved to the STOP position. FIG. 4 also shows that the stabilizer buttons 312 and 314 are replaced by a single rocker switch 402. Further, the pressure relief function previously accomplished by rotating key 310 to the far counter clockwise position is replaced in FIG. 6 with a rocker switch 404.

Thus, it can be seen that the present invention provides a system which allows operation of attachments 12 from outside operator cab 18. In one illustrative embodiment of the present invention the operator is allowed to start and run loader 10, while it remains stationary, as well as to selectively allow hydraulic fluid flow to attachment 12. If the engine of loader 10 is started from the remote attachment control device, all functions within the cab can be disabled, except the stop button. Further, if the key in the cab is turned once the loader 10 has already been started from the remote attachment control device, this also shuts down machine 10. In addition, the present invention provides a two-person operation mode in which one operator is located inside the cab 18 of loader 10, seated on seat 20, with seat bar 22 in the lowered position. A second operator is located outside of the cab 18, in the area of attachment 12. When machine 10 is started from within the cab, all functions on the remote attachment control device are disabled, other than the stop button. Also, if the second operator attempts to start the machine from the remote attachment control device after it has already been started from within cab 18, the engine is stopped.

It should also be noted that the present invention can be used with a hand held attachment. In such an embodiment, once valve 48 has been opened, even in the two-person operation mode, the second operator operating the hand held tool may control the provision of hydraulic fluid to the hand held tool, such as through a trigger or other device located on the hand held tool which controls a valve on the hand held tool. However, the availability of hydraulic fluid to the hand held tool, through valve 48, is still controlled by the first operator who resides within cab 18.

Finally, it should again be noted that no operator control panel 90 need be provided. Instead, ACD 52 can simply receive an identification from attachment 12 indicating the type of attachment to which it is connected. Then, ACD 52 can simply control the valves coupled to the attachment hydraulic actuators or the electric actuators such that power is applied to appropriate actuators. This is, of course, based at least in part on the particular type of attachment which has been identified by ACD 52.

When no operator control panel 90 is provided, the user can simply operate the attachment from inside the cab or operator's compartment. In that instance, main control computer 86 provides a signal to ACD 52 indicating which buttons have been depressed on the electronic controls 66. In response, and based on the type of attachment identified by the ACD 52, ACD 52 provides a signal back to computer 86 indicating where hydraulic flow is desired. Computer 86 then provides an appropriate signal to hydraulic circuit 82 thus providing hydraulic fluid under pressure at a suitable output (such as the front or rear auxiliaries, or any other suitable hydraulic coupler). In this way, ACD 52 essentially makes many of the decisions as to where hydraulic fluid will be provided from machine 10, whether it will be provided in a high flow fashion, etc. This is based on the actuators depressed by the operator in the cab of machine 10 and based on the type of attachment to which machine 10 is then attached. Of course ACD 52 can also provide suitable outputs to the attachment to control any valves on the attachment which need to be controlled in order to provide hydraulic fluid under pressure at the appropriate place on the attachment.

Although the present invention has been described with reference to preferred embodiments, workers skilled in the art will recognize that changes may be made in form and detail without departing from the spirit and scope of the invention.

What is claimed is:

1. A power machine having an engine and an attachment connected thereto, the power machine comprising:

a first input device positioned outside a cab portion of the power machine, the first input device including a first plurality of input mechanisms for controlling the attachment, wherein the first input device further includes a first engine start mechanism for starting the engine;

a second input device positioned inside the cab portion of the power machine, the second input device including a second plurality of input mechanisms for controlling the attachment, wherein the second input device further includes a second engine start mechanism for starting the engine; and a control system operably connected to the power machine and operably connecting the first and second input devices, wherein the control system includes a lockout function device that disables a predetermined set of operator-actuated functions based on a determination as to which of the first and second engine start mechanisms is used to start the engine.

2. The power machine of claim 1, wherein the first input device is substantially disabled when the second engine start mechanism is used to start the engine.

3. The power machine of claim 1, wherein the control system is configured so the power machine and the attachment are completely shut down if an attempt is made to use one of the first and second engine start mechanisms after the other of the first and second start mechanisms has already been used to start the engine.

4. The power machine of claim 1, wherein substantially all functions adapted to be controlled by an operator within the cab portion of the power machine, including functions associated with the second input device, are disabled when the first engine start mechanism is used to start the engine.

5. The power machine of claim 4, further including a shut down mechanism positioned within the cab portion of the power machine and for completely shutting down operation of the power machine and the attachment, wherein the shut down mechanism remains actuatable when the first engine start mechanism is used to start the engine.

6. The power machine of claim 4, wherein the power machine includes a traction mechanism for driving the power machine and wherein the traction mechanism is disabled when the first engine start mechanism is used to start the engine.

7. The power machine of claim 6, further including a traction override mechanism positioned within the cab portion of the power machine and actuable so that after the traction mechanism has been disabled following use of the first engine start mechanism to start the engine, actuation of the traction override mechanism re-enables the traction mechanism.

8. The power machine of claim 6, wherein the first input device further includes a traction override mechanism actuable so that after the traction mechanism has been disabled following use of the first engine start mechanism to start the engine, actuation of the traction override mechanism re-enables the traction mechanism.

9. The power machine of claim 1, wherein the first input device is substantially disabled when the second engine start mechanism is used to start the engine.

10. The power machine of claim 1, wherein substantially all functions adapted to be controlled by an operator outside the cab portion of the power machine, including functions associated with the first input device, are disabled when the second engine start mechanism is used to start the engine.

11. The power machine of claim 10, wherein the first input device further includes a shut down mechanism for completely shutting down operation of the power machine and the attachment, wherein the shut down mechanism remains actuatable when the second engine start mechanism is used to start the engine.

12. The power machine of claim 1, wherein the first input device remains enabled when the second engine start mechanism is used to start the engine.

13. The power machine of claim 1, wherein the attachment is a hand held tool and wherein the first input device is attached to the hand held tool.

14. A power machine having an engine, the power machine comprising:

a hydraulic power system connected to at least one valve member that is further connected to an actuation portion of an attachment;

a first operator input device positioned outside a cab portion of the power machine and mounted to one of the power machine and the attachment, the first operator input device being configured to provide a first set of operator input signals based on a first plurality of operator inputs, said first operator input device further including a first engine start mechanism for starting the engine;

an electronic controller operably coupled to the first operator input device and configured to control, based on the first set of operator input signals, a hydraulic fluid flow through said at least one valve and between the hydraulic power system and the actuation portion of the attachment;

a second operator input device positioned inside the cab portion of the power machine and configured to provide a second set of operator input signals based on a second plurality of operator inputs and further including a second engine start mechanism for starting the engine;

a main control computer operably coupled to the second operator input device and configured to control, based on the second set of operator input signals, a hydraulic fluid flow through said at least one valve and between the hydraulic power system and the actuation portion of the attachment;

wherein the electronic controller is operably coupled to the main control computer and wherein the electronic controller controls said hydraulic fluid flow by actively controlling the main control computer; and wherein the electronic controller communicates with the main control computer so as to disable a predetermined set of operator-actuated functions based on a determination as to which of the first and second engine start mechanisms is used to start the engine.

15. The power machine of claim 14, wherein the electronic controller further controls said hydraulic fluid flow by actively controlling said at least one valve.

16. The power machine of claim 14, wherein the electronic controller is configured to receive an indication signal from the attachment and provide a control signal to the control computer to control the hydraulic flow based on the identification signal.

17. The power machine of claim 16, wherein the electronic controller further controls the hydraulic flow actively controlling said at least one valve based on the identification signal.

18. The power machine of claim 14, wherein the second operator input device is substantially disabled when the first engine start mechanism is used to start the engine.

19. The power machine of claim 14, wherein substantially all functions adapted to be controlled by an operator within the cab portion of the power machine, including functions associated with the second operator input device are disabled when the first engine start mechanism is used to start the engine.

20. The power machine of claim 19, further including a shut down mechanism positioned within the cab portion of the power machine and for completely shutting down operation of the power machine and the attachment, wherein the shut down mechanism remains actuatable when the first engine start mechanism is used to start the engine.

21. The power machine of claim 19, wherein the power machine includes a traction mechanism for driving the power machine and wherein the traction mechanism is disabled when the first engine start mechanism is used to start the engine.

22. The power machine of claim 21, further including a traction override mechanism positioned within the cab portion of the power machine and actuable so that after the traction mechanism has been disabled following use of the first engine start mechanism to start the engine, actuation of the traction override mechanism re-enables the traction mechanism.

23. The power machine of claim 14, wherein the first operator input device is substantially disabled when the second engine start mechanism is used to start the engine.

24. The power machine of claim 14, wherein substantially all functions adapted to be controlled by an operator outside the cab portion of the power machine, including functions associated with the first operator input device, are disabled when the second engine start mechanism is used to start the engine.

25. The power machine of claim 24, wherein the first operator input device further includes a shut down mechanism for completely shutting down operation of the power machine and the attachment, wherein the shut down mechanism remains actuatable when the second engine start mechanism is used to start the engine.

26. The power machine of claim 14, wherein the first operation input device remains enabled when the second engine start mechanism is used to start the engine.

27. A method of operation for a power machine having a plurality of input devices including a first input device positioned outside a cab portion of the power machine, and a second input device positioned inside a cab portion of the power machine, wherein the first and second input devices respectively include a first and second engine start mechanism for starting an engine of the power machine, and wherein both devices are connected to a control system that is operably connected to the power machine and enables control of an attachment connected to the power machine, the method comprising:

making a determination as to which of said first and second engine start mechanisms started the engine; and controlling the plurality of input devices based on the determination.

28. The method of claim 27, wherein making a determination comprises determining the first engine start mechanism started the engine, and wherein controlling the plurality of input devices comprises substantially disabling the second input device.

29. The method of claim 27, wherein making a determination comprises determining the first engine start mechanism started the engine, and wherein controlling the plurality of input devices comprises disabling substantially all functions adapted to be controlled by an operator within the cab portion of the power machine, including functions associated with the second input device.

30. The method of claim 27, wherein making a determination comprises determining the second engine start mechanism started the engine, and wherein controlling the plurality of input devices comprises substantially disabling the first input device.

31. The method of claim 27, wherein making a determination comprises determining the second engine start mechanism started the engine, and wherein controlling the plurality of input devices comprises disabling substantially all functions adapted to be controlled by an operator outside the cab portion of the power machine, including functions associated with the first input device.

32. The method of claim 27, wherein making a determination comprises determining the second start mechanism started the engine, and wherein controlling the plurality of input devices comprises maintaining the operability of both first and second input devices.

* * * * *